US006446701B1

(12) United States Patent
Das

(10) Patent No.: US 6,446,701 B1
(45) Date of Patent: Sep. 10, 2002

(54) APPARATUS FOR UNIDIRECTIONAL SOLIDIFICATION OF COMPOUNDS

(76) Inventor: Niranjan Das, D - 11/3, Lab. Qtrs., Kanchanbagh, Hyderabad-500 058 (IN)

( * ) Notice: Subject to any disclaimer, the term of this patent is extended or adjusted under 35 U.S.C. 154(b) by 0 days.

(21) Appl. No.: 09/567,588

(22) Filed: May 10, 2000

Related U.S. Application Data

(63) Continuation of application No. 08/838,894, filed on Apr. 11, 1997, now abandoned.

(51) Int. Cl.[7] ..... B22D 25/00; B22D 27/04

(52) U.S. Cl. ..... 164/338.1; 164/122.2; 164/258

(58) Field of Search ..... 164/122.1, 122.2, 164/338.1, 256, 257, 258

(56) References Cited

U.S. PATENT DOCUMENTS 5,261,480 A * 11/1993 Wortmann et al. ..... 164/256

5,275,228 A * 1/1994 Wortmann et al. ..... 142/122.2

* cited by examiner

*Primary Examiner*—Kuang Y. Lin

(74) *Attorney, Agent, or Firm*—Venable; George H. Spencer; Ashley J. Wells

(57) ABSTRACT

An improved apparatus for producing unidirectionally solidified components over wide range of shapes and sizes from the smallest aero-engine turbine parts to the largest industrial gas turbine parts with improved quality and productivity where a chill block is equipped with a seed crystal ejector mechanism inserts seed crystals into shell mold at the instant of melt pouring and where an intermediate melt pouring funnel indexing device facilitates smooth pouring of melt in instalments in order to cast large and tall directionally solidified castings in relatively thin walled mold at faster mold withdrawl rate with finer and better metallurgical structure and higher production rate than the prior art.

8 Claims, 3 Drawing Sheets

VIEW ON SECTION 3B-3B

APPARATUS FOR UNIDIRECTIONAL SOLIDIFICATION OF COMPOUNDS

CROSS-REFERENCE TO RELATED APPLICATION

This Application is a continuation of U.S. application No. 08/838,894 filed Apr. 11, 1997, now abandoned.

FIELD OF INVENTION

This invention relates to an apparatus for unidirectional solidifications of components such as turbine blades and vanes.

DESCRIPTION OF PRIOR ART

Apparatus for directional solidification of turbine parts are known in the art and comprise an open bottom hot ceramic mold containing molten alloy mounted on a water cooled copper chill block and pulled out of a mold heater in a controlled manner. The casting solidifies from the top of the chill-block (i.e. mould bottom) unidirectionally upward by heat conduction into the chill-block via the solidified part of the casting initially and later by radiative heat transfer from the mold-wall to the water cooled furnace-wall as the resistance against heat conduction to the chill-block through the increasing length of solidified part goes above that of heat conduction from solidifying casting to mold wall and radiative of heat transfer from mold wall to the water-cooled furnace wall. A variety of equipments designs are known ranging from large capacity furnaces employing as much as 50 kg of superalloy melting crucible and large molds of about 150 mm diameter and 600 mm height to furnace designs for casting in molds as small as 140 mm diameter and height about 200 mm. Large sized furnaces offer higher production rate but poor casting quality owing to low temperature gradient across the solid liquid interface compared to those with relatively smaller mold heaters. Higher processing temperatures in large sized furnaces provided an improved temperature gradient, but result in poor casting quality due to increased melt-mold reactions or else would require costly molding systems to avoid or reduce melt-mold reactions. Smaller furnace designs on the other hand lead to better quality castings but for small to medium sizes only. Adequate mould rigidity against metallostatic pressure in the case of large and tall components requires increasingly thick mold wall (in proportion to mold height) which in turn deteriorates the temperature gradient across the solid liquid interface of the solidifying casting. Moreover such furnaces of the prior art often do not have precise control over the crystallographic orientation of single crystal components since the crystal generally emerges here through random nucleation and grain growth competition in helical grain selectors or other geometrical constructions. In the furnace of U.S. Pat. No. 4,469,161, seed crystal of desired crystallographic orientation is placed to the mold bottom so that the same seed texture will extend into the component as solidification proceeds from the bottom to the top of the mold cavity. The casting yield however, in such case has been only marginal since the said crystal surface is subjected to an aggressive atmosphere during mold heating due to vaporisation of volatile compounds and also to oxidation in the dynamic vacuum at high temperature (−155° C.). All these factors increase the risk of polycrystalline growth.

Better control of crystal orientation through seed implantation can be achieved if the seed crystal enters the mold after heating the mold to the desired temperature just at the event of melt pouring into the mold. European Patent no 0496978 A1 and U.S. Pat. No. 5,261,480 disclose a seeding method for single crystal component casting using a complex arrangement of splitting the furnace into four or more separate chambers employing several vacuum interlocks and transporting devices for loading, unloading and heating of remelt bar, mold and seed crystal in isolation from one another and then simultaneously bringing melt (by tilt pouring) and seed crystal (by quick movement of seed carriages from lower to upper chamber and actuating a clamping device to hold the mold tightly against any melt leakage) and simultaneously inserting the seed crystals into the mold. All these require precision movement of various parts with faithful interlocking, sequencing and quick start-stop movements with positional and durational accuracy and repeatability in vacuum at high temperature avoiding any impact between various parts or melt leakage where occurrence of refractory debris with time and melt droplets due to melt pouring is unavoidable.

OBJECTS OF THE INVENTION

An object of this invention is to propose an apparatus for producing columnar grained as well as single crystal castings over a wide range of shapes and sizes (from about 50 mm to about 500 mm length) with very high casting quality and productivity.

Another object of this invention is to propose an apparatus with minimum vacuum sealing joints in order to minimise leak rate and to rely upon very few mechanisms involving very few moving or sliding parts and achieve thereby greater reliability, operational case and less maintenance relative to the apparatus of the prior art.

Yet another object of the invention is to propose an apparatus for casting large and tall components in much thinner molds in order to improves metallurgical quality and productivity employing much less induction melting capacity than what the furnaces of the prior art require.

SUMMARY OF THE INVENTION

According to this invention there is provided an apparatus for producing unidirectionally solidified components over wide range of shapes and sizes from the smallest aero-engine turbine parts to the largest industrial gas turbine parts with improved quality and productivity comprising at least a first unit having;

(i) at least one melting and casting chamber having mold heating station, an induction melting coil and an intermediate melt pouring funnel indexing device;

(ii) at least one mold charging compartment for said casting chamber, a movable chill block disposed within said mold charging compartment, a seed crystal within said chill-block, an actuator for-raising and lowering the chill block, a seed crystal ejector coaxially disposed within said actuator and so as to cause a displacement of the seed crystal independent to that of the chill block;

(iii) at least one alloy-bar-stock charging compartment;

(iv) an alloy bar stock melting crucible adapted to be disposed within said casting chamber;

(v) a vacuum pumping system for the melting and casting chamber;

(vi) a mechanical vacuum pump for the aloy bar stock and molding charging compartments.

The apparatus in accordance with one embodiment of the present invention comprises at least a first unit having a single melting and casting chamber with an alloy bar stock compartment and mold charging chamber at the chamber top and bottom via small isolation valves. For efficient production of single crystal components with desired crystal orientation, a heat conductive chill block that clamps and carries the ceramic mold is provided with an ejector to insert seed crystals into the preheated mold at the instant of melt pouring. A hot zone for mold heating is designed for precise control of solid-liquid interface position and desired level of temperature gradient at the interface employing an optimum aperture of radiation baffle to accomplish defect free unidirectional freezing at a minimum hot zone temperature. The apparatus of this invention is capable of casting either one component at a time or several components clustered together in the ceramic mold depending upon the component cross section. Unidirectional solidification for tall components having large cross-sections in relatively thin walled molds takes place because of its intermediate melt pouring funnel indexing device for melt pouring in instalments. An added advantage of this arrangement is the scope to make larger castings than the induction melting capacity with the concept of quick melting in open-bottom small-crucibles and quiet pouring of clean melt therefrom.

In accordance with another embodiment several such first units are radially connected via isolation valves to a central diffusion pump of a single vacuum pumping system. A separate roots blower-mechanical vacuum pump combination is provided for the alloy barstock and mold charging compartments to ensure increased production and efficient machine utilisation.

In accordance with the yet another embodiment for unidirectional solidification of components of large size both in height, cross-section, and casting thickness, a low melting liquid metal bath instead of seed crystal is provided under the radiation baffle of the mold heating hot zone for efficient heat transfer and high temperature gradient across the solid-liquid interface of the solidifying casting. The chill block arrangement along with mold charging compartment is placed at the top of melting and casting chamber in place of alloy bar stock charging compartment that is displaced to the periphery.

In accordance with another embodiment, an apparatus is provided including at least one of the first unit described in the foregoing and a second unit having a casting chamber with an induction melting coil horizontally retractable and its mold charging compartment disposed at the chamber top, adjacent to the alloy charging compartment.

DESCRIPTION OF THE PREFERRED EMBODIMENTS

Figure 1:
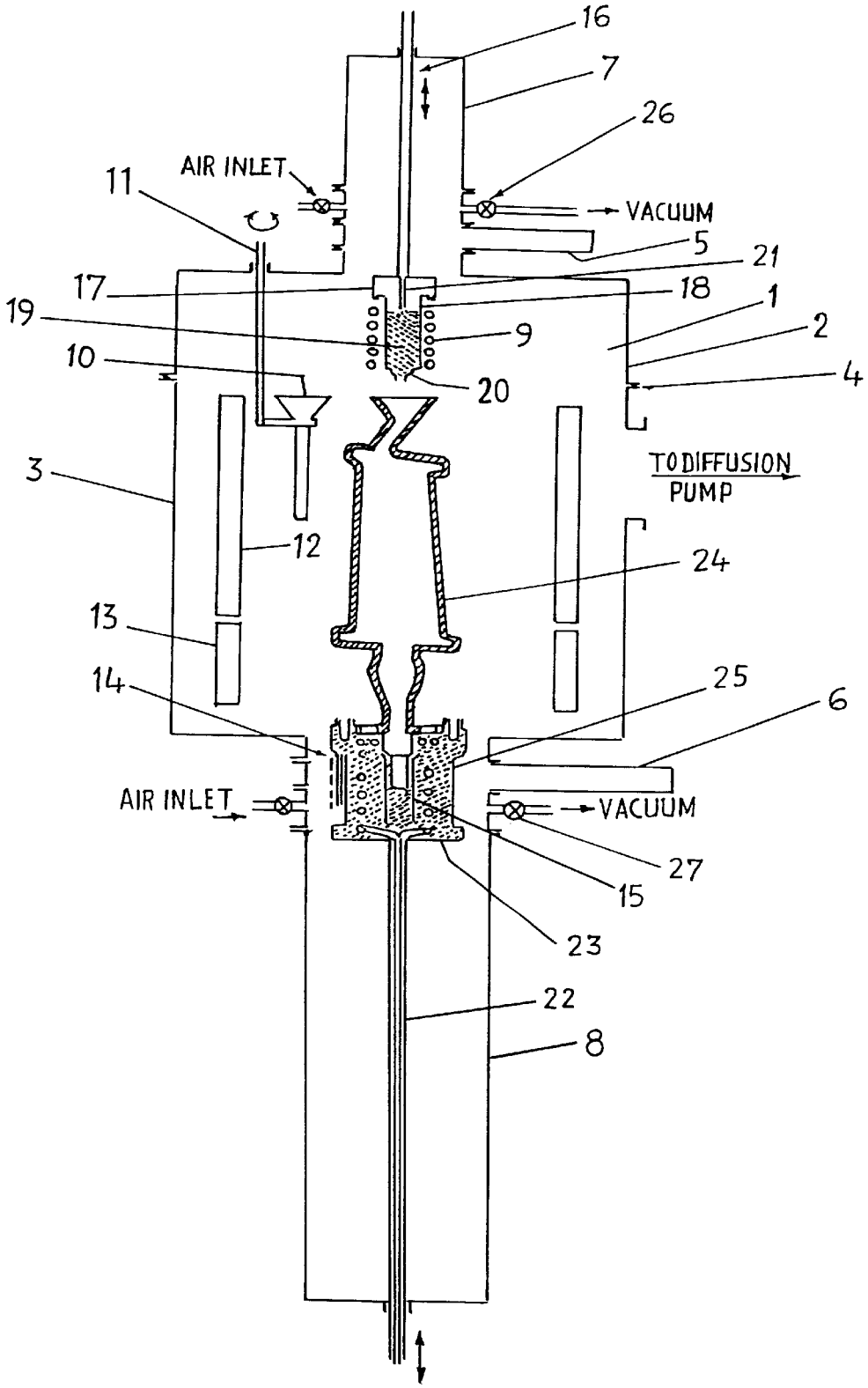
FIG. 1 Shows an elevation view of the apparatus for unidirectional solidifications of components in accordance with one embodiment.

FIG. 1 shows the overall arrangement of the apparatus in a vertical sectional view. It comprises a first unit of essentially a single chamber 1 made out of two cylindrical vessels 2 and 3 which are water cooled and sealed against each other at the vacuum tight flange 4. This split design of the chamber is for the ease of apparatus fabrication, installation and maintenance. The dome shaped ends of each vessel are fitted with vacuum valves 5 and 6 for connecting the alloy bar stock charging compartment 7 at the top and the mold charging compartment 8 at the bottom after evacuation. The top half of the chamber has an induction coil 9 for melting alloy bar stock. It also has an intermediate melt pouring funnel 10 and its indexing shaft 11. The bottom half of the chamber is equipped with two mold heaters 12 and 13, and an actuating means 14 for the seed crystal ejecting mechanism 15 which is coaxially disposed within the actuating means 14. The alloy bar stock charging compartment 7 has a transport mechanism 16 to move crucible holder 17 up on down along with the crucible 18 containing alloy bar stock 19 and metal plug 20. The crucible holder carries a thermometric device 21 to measure melt temperature. Though FIG. 1 shows a single bar charging compartment, the first unit may comprise two such alloy bar charging compartments mounted on a pivot so that when one is engaged at the alloy melting position, the used crucible from the other one is replaced by new crucible containing fresh alloy bar and metal plug. The construction of the pivot mechanism is not illustrated as any such mechanism may be provided.

The mold charging compartment is equipped with a water-cooled ram-shaft 22 carrying a chill block 23. The chill block has provisions to clamp the ceramic mold 24 to prevent melt leakage between mold bottom and itself, as well as to keep the seed crystal 25 in its water cooled cavity and to insert them into the mold cavity just before the melt would enter into the mold. The ram-shaft 22 may move upward as well as downward, along with the ceramic mold over wide range of speed time schedules in a smooth and vibration free manner. In the embodiment of two alloy bar charging compartments, the first unit also comprises two such mold charging compartments 8 mounted on a pivot so that the seed crystals and ceramic mold can be placed on one of them while the other is engaged with the casting chamber in directional solidification. In a likewise manner, any known pivot mechanism may be provided. Melting and casting chamber 1 is connected to the diffusion pump of a vacuum pumping system. The alloy bar charging compartment 7 and the mold charging compartment 8 are connected to another vacuum pump set independently through their respective isolation valves 26 & 27.

Figure 2:
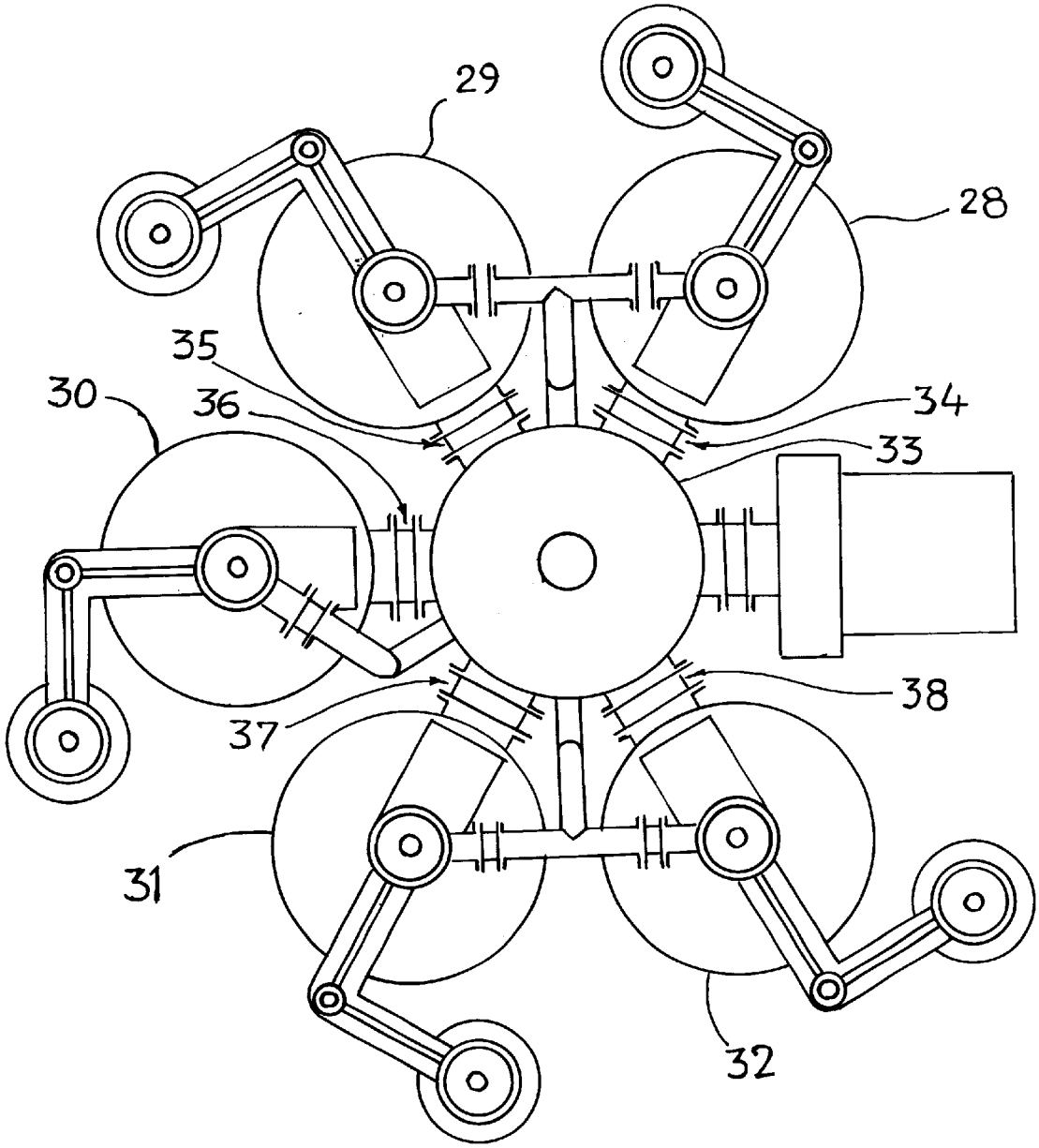
FIG. 2 Shows a plan view of several single chamber casting modules coupled to a single vacuum pumping system.

In a preferred construction, a number of such first units are coupled to the same vacuum pumping system. FIG. 2 shows a plan view of such an arrangement where five first units 28, 29, 30, 31 and 32 are connected to a centralized diffusion pump 33, through their respective isolation valves 34, 35, 36, 37 and 38 so that the running or shut down condition of any of the casting chambers can not prevent the functioning of the remaining casting chambers.

Figure 3A:
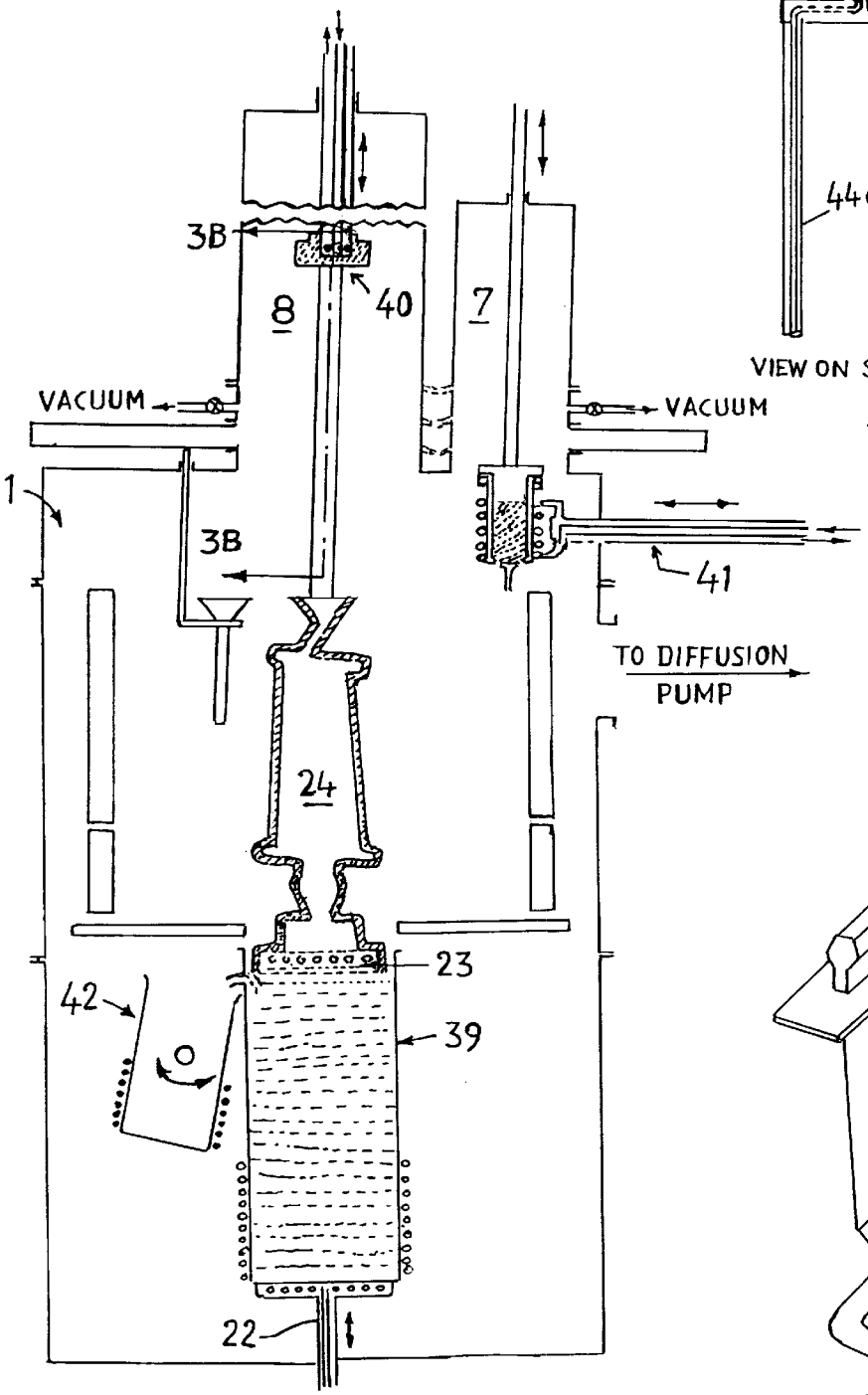
FIG. 3A Shows an elevation view of the apparatus for unidirectional solidification of very thick and large castings employing metal coolant.
Figure 3B:
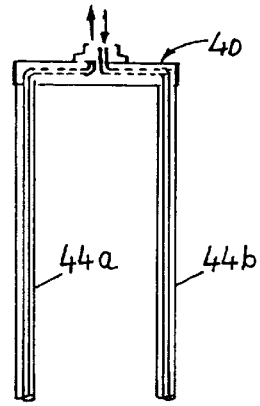
FIG. 3B is a view on section 3B—3B.

In another preferred construction that is especially suitable for undirectional solidification of very thick components, a low melting liquid bath 39 is provided as shown in FIG. 3A. The mold charging compartment 8 in this case is placed at the top of the melting and casting chamber 1 and the alloy charging compartment 7 is placed adjacent to it. The chill-block supporting structure has a ram shaft just like item 22 of FIG. 1 having coaxial water inlet and outlet. The chill block 23 is aligned to the bottom of the horizontal coupling beam 40 by two rigid pipes 44*a*, 44*b* for inlet and outlet water running parallel and well separated from each other in order to clamp a ceramic mold 24 onto the chill block 23 at the center as shown in FIG. 3B. These two rigid pipes and chill block are plasma coated and protected with insulation ceramics against hot zone temperature and the low melting liquid in the bath 39. Thus, the chill block 23 is co-axially connected to a water cooled actuator 22 through a plasma coated, water cooled support structure which is protected with insulation ceramics against mold heater temperatures and the liquid metal bath. The melting coil is mounted onto a retractable coaxial power feed-through 41. A pivoted pot 42 is provided adjacent to the low melting liquid bath 39 to collect the displaced liquid upon progressive lowering of the mold. In such an embodiment, a seed crystal is not provided in the chill block, and that a solidification of the casting is caused by bath 39.

The invention includes an apparatus having at least one first unit, for example, as shown in FIG. 1, and a second unit as shown in FIG. 3.

OPERATION

The melting and casting chamber 1 is evacuated with the valves 5 and 6 being in closed position. The mold heaters 12 and 13 are then switched on to attain a desired temperature. The bottom open melting crucible 18 with the alloy bar stock 19 and metal plug 20 in position is placed on the crucible holder 17. The crucible transport mechanism 16 is actuated to take the crucible inside the alloy bar stock charging compartment 7 which is then placed on the vacuum sealing flange over the isolation valve 5. After evacuation of the alloy bar stock charging compartment 7, valve 5 is opened and crucible 18 is lowered by its transport mechanism 16 into the induction melting coil 9. Single crystal seeds are loaded into the ejecting mechanism 15 inside the chill block 23. The ceramic mold 24 is then placed on chill block 23 and clamped after proper indexing with the ejecting mechanism 15. The chill block 23 is lowered by its transport mechanism 22 to bring the mold below the sealing flange of mold charging compartment 8 which is then aligned with the chamber bottom and clamped. After evacuation of the mold charging compartment 8, the valve 6 is opened and the chill block 23 along with ceramic mold 24 is raised to the initial casting position. After a desired duration of mold soaking in the hot zone, power to the induction melting coil 9 is turned on. As soon as the thermometric device 21 reads the desired pouring temperature the seed crystals are pushed into the mold cavity by actuating the ejecting mechanisms 15. The melt is bottom poured into the ceramic mold 24 automatically within a couple of seconds as the metal plug 20 melts at the desired pouring temperature. Solidification of single crystal components proceeds from the seed crystals as the mold is withdrawn from the hot zone in a controlled manner with the help of the transport mechanism of the ram shaft 22. The used crucible is taken back into the alloy charging compartment 7 after melt pouring. The isolation valves 26 and 5 are closed and air-is allowed into the alloy charging compartment 7 up to atmospheric pressure. This alloy charging compartment 7 is swung back in order to place another alloy charging compartment having that pivoted in conjunction with the first one for loading fresh crucible containing alloy bar and metal plug into the melting coil 9. Tall castings of larger volume, than crucible capacity are produced by repeating the alloy loading-melting pouring cycles well before the melt of previous pouring would solidify completely. Smooth pouring is assured inspite of the withdrawal by placing the intermediate melt pouring funnel 10 in the gap between mold and crucible with the help of its indexing shaft 11.

After complete mold withdrawal, the valve 6 is closed and air is allowed into the mold charging compartment 8 up to atmospheric pressure. This mold charging compartment containing the casting now is swung back in order to place another mold charging compartment that is pivoted in conjunction with the first one to load fresh mold for the next casting cycle. The cast components are taken out and the chill block is prepared for loading fresh seed crystals and mold to continue with the process. Columnar grained castings can be produced simply by not using any single crystal seed and keeping the ejecting mechanisms in ejected position.

The operation in the case of the cooling arrangement through the low melting temperature liquid bath of FIG. 3 is similar except for the following:

i. The mold is lowered from the top of the melting casting chamber 1 into the hot zone upto pouring position.

ii. The alloy charging mechanism 16 leaves the crucible containing alloy bar 19 and metal plug 20 in the induction melting coil 9 that is then pushed forward with the help of the retractable power feed-through 41 to come just above the pouring cup of the mold. After alloy melting and pouring it goes back to receive the next batch of alloy charge just below the alloy charging cup.

iii. After complete solidification of the casting, the hot zone temperature is lowered well below the incipient melting temperature of the solidified casting. The chill-block along with the mold and casting is lifted up into the mold charging compartment 8 and the isolation valve is closed in order to take the mold and casting out and charge a fresh mold for the next casting cycle.

iv. The low melting temperature liquid bath 39 is lowered and the displaced liquid collected in the pivoted pot 42 is tilt poured into the bath 39. The liquid bath 39 is then pushed up to the casting position for the next casting cycle.

Figure 4:
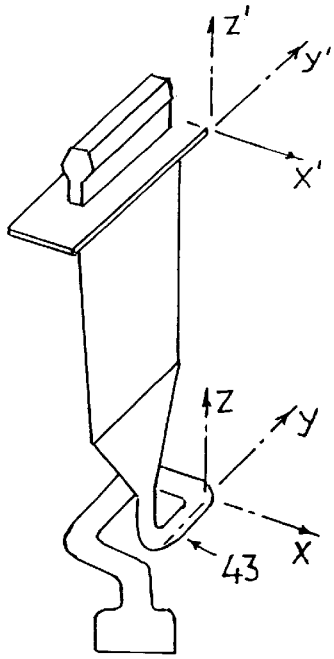
FIG. 4. Shows an isometric view of casting configuration employing an orthogonally helical crystal selector for longitudinal as well as transverse control or crystallographic orientation in the casting.

Superior texture in the columnar grained casting is obtained by the apparatus of the present invention due to high rate of heat extraction through the water cooled chill block relative to the prior art of cooling through a low melting temperature liquid bath. Similarly, superior control over longitudinal and transverse texture in single crystal casting is obtained more conveniently by employing orthogonal helix 43 and aligning the transverse axes (X', Y') of component with those (X', Y') of the orthogonal helix as shown in the FIG. 4 as compared to prior art of cooling through low melting liquid bath.

Although the invention has been described with reference to a specific embodiment thereof, it will become apparent to those skilled in the art that numerous modifications and variations can be made within the scope and spirit of the invention if defined by the following claims:

What is claimed is:

1. An apparatus for producing unidirectionally solidified components having a wide range of shapes and sizes from the smallest aero-engine turbine parts to the largest industrial gas turbine parts with improved quality and productivity, comprising:

at least one first unit having:

(i) at least one melting and casting chamber including an induction melting coil, an intermediate melt pouring funnel, and an intermediate melt pouring funnel indexing device, a mold, and a mold heating station;

(ii) at least one mold charging compartment connected to the at least one melting and casting chamber, a movable chill block disposed within the at least one mold charging compartment, a seed crystal disposed within the movable chill block, an actuator connected to the movable chill block for raising and lowering the movable chill block, and a seed crystal ejector coaxially disposed within an actuating means so as to cause a displacement of the seed crystal independent to that of the movable chill block;

(iii) at least one alloy-bar-stock charging compartment;

(iv) an alloy-bar-stock melting crucible positioned to receive an alloy-bar-stock from the alloy-bar-stock charging compartment and adapted to be disposed within the at least one melting and casting chamber;

(v) a vacuum pumping system connectable to the at least one melting and casting chamber for evacuating the at least one melting and casting chamber; and (vi) a mechanical vacuum pump connectable to the at least one alloy-bar-stock charging compartment and connectable to the at least one mold charging compartment.

2. The apparatus as claimed in claim 1, comprising two mold charging compartments each mounted on a pivot, each of the two mold charging compartments having a chill block and a seed crystal provided within said chill block, and two alloy-bar-stock charging compartments mounted on a pivot.

3. The apparatus as claimed in claim 1, wherein the at least one alloy-bar-stock charging compartment holds the melting crucible which is an open-bottom-crucible fitted with a metal plug that seals the bottom of the open-bottom-crucible temporarily until the alloy melts, attains a pouring temperature, and causes the metal plug to melt and allow the molten alloy to flow down into the mold.

4. The apparatus as claimed in claim 1, wherein said intermediate melt pouring funnel has an indexing device which aligns the intermediate melt pouring funnel between the melting crucible and the moving mold.

5. The apparatus as claimed in claim 1, wherein said chill block holds the mold up, into the mold heating station for pre-heating while keeping the seed crystal away from heat to prevent at least one of oxidation and recrystallization.

6. The apparatus as claimed in claim 1, further comprising a second unit having (i) at least one melting and casting chamber including an induction melting coil which is horizontally retractable, an intermediate melt pouring funnel, and an intermediate melt pouring funnel indexing device, a mold, and a mold heating station;

(ii) a mold charging compartment positioned at the top of the at least one melting and casting chamber and a movable chill block disposed within the at least one mold charging compartment;

(iii) an alloy-bar-stock charging compartment connected to the induction melting coil which is horizontally retractable and positioned adjacent to the mold-charging compartment;

(iv) an alloy-bar-stock melting crucible positioned to receive an alloy-bar-stock from the alloy-bar-stock charging compartment and adapted to be disposed within the at least one melting and casting chamber;

(v) a liquid metal bath to extract heat efficiently from the solidifying melt in the mold;

(vi) a vacuum pumping system connectable to the at least one melting and casting chamber for evacuating the at least one melting and casting chamber; and (vii) a mechanical vacuum pump connectable to the at least one alloy-bar-stock charging compartment and connectable to the at least one mold charging compartment.

7. The apparatus as claimed in claim 6, wherein the chill block is co-axially connected to a water cooled actuator through a plasma coated, water cooled support structure which is protected with insulation ceramics against mold heater temperatures and the liquid metal bath.

8. The apparatus as claimed in claim 6, wherein an orthogonally helical grain selector is provided, in the mold, and results in single crystal airfoil castings with crystallographic orientation along the longitudinal and transverse directions when the air foil chord is orthogonally aligned with the orthogonally helical grain selector.

* * * * *